United States Patent [19]

Morand

[11] Patent Number: 4,570,815

[45] Date of Patent: Feb. 18, 1986

[54] FLUID-TIGHT CONNECTING STRUCTURE AND STORAGE TANK IN PARTICULAR FOR A MOLTEN SALT, FITTED WITH SAID STRUCTURE

[75] Inventor: Pierre Morand, Feucherolles, France

[73] Assignee: Technigaz, France

[21] Appl. No.: 602,958

[22] Filed: Apr. 23, 1984

[30] Foreign Application Priority Data

Apr. 25, 1983 [FR] France ..... 83 06762

[51] Int. Cl.[4] ..... B65D 7/24

[52] U.S. Cl. ..... 220/75; 220/67; 220/54

[58] Field of Search ..... 220/67, 73, 75, 80, 220/5 A

[56] References Cited

U.S. PATENT DOCUMENTS

| | | | |
|---|---|---|---|
| 3,150,795 | 9/1964 | Schlumberger | 220/75 X |
| 4,191,303 | 3/1980 | Kinghorn, Sr. et al. | 220/222 |

FOREIGN PATENT DOCUMENTS

| | | | |
|---|---|---|---|
| 0049313 | 4/1982 | European Pat. Off. . | |
| 1601215 | 9/1970 | France . | |
| 2400667 | 3/1979 | France . | |
| 87757 | 7/1956 | Norway | 220/75 |
| 1573849 | 8/1980 | United Kingdom . | |

*Primary Examiner*—Steven M. Pollard

[57] ABSTRACT

An element in particular for a fluid-tight connecting structure between the side wall and the roof of a storage tank in particular for a molten salt, consisting of an arcuate sheet metal strip provided with at least one longitudinal projecting corrugation the crest of which is formed with spaced transverse depressions, said projecting corrugation having a cross-section in the shape of an acute angle.

12 Claims, 4 Drawing Figures

FLUID-TIGHT CONNECTING STRUCTURE AND STORAGE TANK IN PARTICULAR FOR A MOLTEN SALT, FITTED WITH SAID STRUCTURE

BACKGROUND OF THE INVENTION

The present invention relates to connecting elements used in the making of a structure for the fluid-tight connection between the side wall and the roof of a storage tank in particular for a molten salt.

There are already known heat-insulated storage tanks in particular for molten salts with a corrugated vertical cylindrical side wall formed with two orthogonally intersecting sets of parallel, respectively straight vertical and circular horizontal corrugations and with a generally flat circular roof suspended within the cylindrical enclosure with a radial play or clearance to proivde for its free thermal expansion.

In the particular case of storage of a molten salt which is at a temperature of 570° C. (eutectic mixture of potassium and sodium salts) the latter has a tendency to rise and to flow over the roof thereby polluting the for instance fibrous insulation covering the outer face or top side of the roof thus impairing its insulating properties.

Moreover the air is heated up through contact with the molten salt and is thus brought to a temperture which is nearly that of the salt so that that air owing to the convection phenomenon is likely to heat dangerously up the upper structure or dome from which the roof is suspended and which being made from carbon steel should not exceed a given temperature.

SUMMARY OF THE INVENTION

The object of the present invention is to avoid these inconveniences by closing off in sealing relationship the gap provided between the side wall and the hanging roof while making possible the free thermal expansion thereof by means of a fluid-tight connecting structure.

The present invention is therefore directed to an element in particular for a connecting structure between the side wall and the roof of a storage tank in particular for a molten salt, characterized in that it consists of an arcuate metal sheet strip formed with at least one projecting longitudinal corrugation the crest or ridge of which is formed with crosswise extending spaced depressions.

According to further characterizing features of the invention, the projecting corrugation has a cross-section forming an acute angle whereas the transverse depressions are substantially of dihedral shapes; the metal sheet being made from an alloy with a high nickel content.

The present invention is also directed to a method of manufacturing said connecting element, characterized in that it consists in forming on an initially flat metal sheet strip at least one longitudinal projecting corrugation through pure folding and then a series of spaced transverse depressions into the crest or ridge of said corrugation and thereafter in bending said strip.

Preferably the bending is carried out according to an arc of circumference of 90°, the projecting corrugation being located on the concave side of the arcuate strip.

The present invention has also for its subject matter a structure for the fluid-tight connection between the upstanding cylindrical in particular corrugated side wall formed with two orthogonally intersecting sets of parallel respectively straight vertical and circular horizontal corrugations and the generally flat circular suspended roof of a storage tank in particular for a molten salt. According to the invention, the structure consists of a number of said connecting elements which are likely to overlap or straddle each other and are secured to each other in particular through welding for defining a spherical annular cupola connecting said flat roof and said cylindrical side wall together.

According to another characterizing feature of the invention, the lower end of each aforesaid element is arranged in inner overlapping relationship with the cylindrical side wall of the tank onto which it is welded for instance while straddling or overlapping with its corrugation the corresponding upper end of a vertical corrugation of the wall.

According to still a further characterizing feature of the invention, the upper end of each aforesaid element is bearing and for instance welded underneath and against the horizontal flange of a reinforcing beam of the hanging roof.

BRIEF DESCRIPTION OF THE DRAWINGS

The invention will be better understood and further objects, characterizing features, details and advantages thereof will appear more clearly as the following explanatory description proceeds with reference to the accompanying diagrammatic drawings given by way of non-limiting example only illustrating a presently preferred specific embodiment of the invention and wherein.

DETAILED DESCRIPTION OF THE PREFERRED EMBODIMENTS

Figure 1:
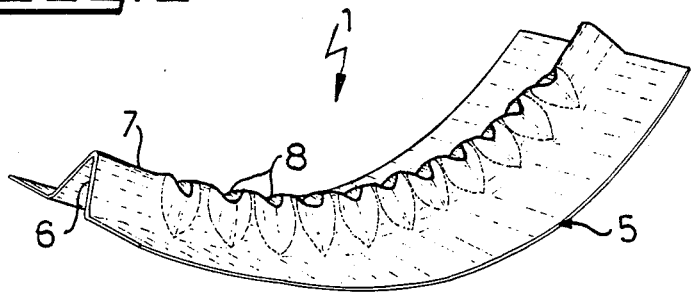
FIG. 1 is a perspective view of a connecting element according to the invention.
Figure 2:
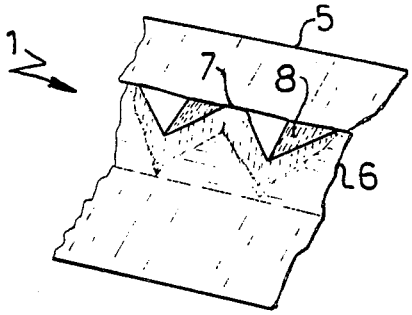
FIG. 2 is a partial perspective view showing an embodiment of the depressions formed into the longitudinal corrugation of said element.

On FIGS. 1 and 2 is a connecting element 1 according to the invention. A number of such connecting elements 1 may be used for making a connecting structure 12 between the side wall 2 and the hanging roof 3 of a storage tank 4 in particular for a molten salt as shown on FIGS. 3 and 4.

The connecting element 1 according to the invention consists of an arcuate metal sheet strip 5 provided with at least one longitudinal projecting corrugation 6 the crest or ridge 7 of which is formed with spaced transverse depressions 8. Preferably, the projecting corrugation 6 has a cross-section in the form of an acute angle. As shown on FIG. 2, the transverse depressions may be of substantially dihedral shapes. However, with a view to reduce the stress concentrations it is advantageous to substitute for the sharp connecting or intersection edges and crest ridges or angles rounded filets with small radii of curvature to avoid local work-hardening of the metal (FIG. 1).

The metal sheet strip 5 should be resistant to heat and not corrodible. It should in particular be made from an alloy with a high nickel content such for instance as the alloy known under the trade name "INCOLOY 800".

This connecting element should be made as follows. In an initially flat metal sheet strip 5 is formed at least one longitudinal projecitng corrugation 6 through pure folding that is without any elongation of the material of the initially flat metal sheet strip. Then by means of a suitable tool a series of spaced transverse depressions 8 are formed into the crest of said corrugation. As previously stated, such depressions may be of substantially dihedral shapes or preferably the sharp connecting or intersection edges and crest ridges and angles are substituted for by rounded fillets with small radii of curvature.

Said strip is thereafter bent into an arc of circumference of 90° for instance the projecting corrugation being positioned on the concave side of the arcuate strip. The bending is facilitated in view of the forming of the transverse depressions, the latter also facilitating the thermal deformations of the metal sheet strip thus curved.

It is also possible to cut the wing portions or side flanges of said strip so that it exhibits an increasing width in order to facilitate the making of the connecting strucutre from said elements.

The fluid-tight connecting structure according to the invention is in particular used to close off in sealing relationship the gap existing between the vertical cylindrical in particular corrugated side wall 2 and the generally flat circular roof 3 of a storage tank 4 in particular for a molten salt. The cylindrical side wall 2 of the tank 4 is formed with two orthogonally intersecting sets of parallel respectively straight vertical corrugations 9 and circular horizontal corrugations 10, a heat insulation 15 being provided onto the outer side of said wall. The roof 3 comprising in particular an insulation 16 and a reinforcing beam 13 is suspended from a top dome or cupola (not shown) by means of an outer framework one member 11 of which is shown.

Figure 3:
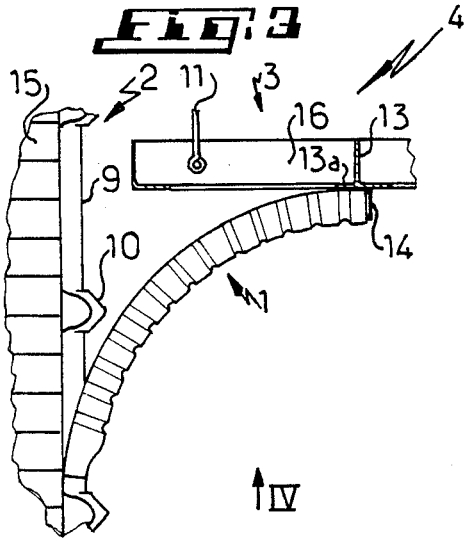
FIG. 3 is a view in partial section of a tank fitted with connecting elements according to the invention.
Figure 4:
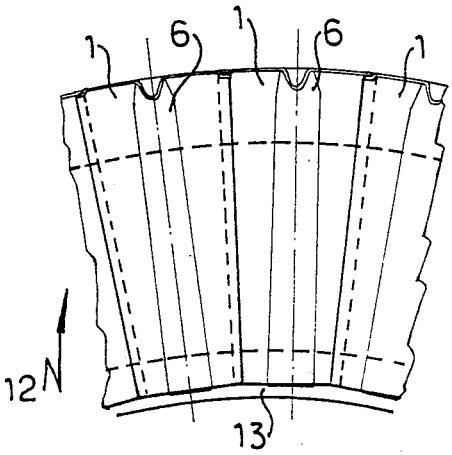
FIG. 4 is a showing viewed in the direction of the arrow IV of FIG. 3.

According to the invention, the connecting structure consists of a number of connecting elements 1 which are likely to overlap or straddle each other and are fastened to each other in particular through welding so as to define an annular poriton of a sphere 12 connecting the flat roof 3 and the cylindrical side wall 2 together (FIGS. 3 and 4).

As shown, the bottom end of each element 1 is arranged in inner overlapping relationship with the cylindrical side wall 2 of the tank 4 onto which it is for instance welded while straddling with its corrugation 6 the corresponding top end of a vertical corrugation 10 of the wall 2, this vertical corrugation projecting radially inwards and thus being nested or fitted into the corrugation 6 of the strip.

Furthermore, the upper end of each element 1 is bearing and for instance welded underneath and against the horizontal flange 13*a* of a reinforcing beam 13 of the hanging roof. A circular sealing packing 14 is provided to shut off the top ends of the corrugations 6 of the various connecting elements 1.

The flat horizontal hanging roof is thus connected in fluid-tight relationship to the cylindrical upstanding side wall 2 by a portion of curved wall substantially in the general shape of a spherical annular cupola consisting of the corrugated arcuate elements 1 straddling or overlapping each other and welded to one another.

What is claimed is:

1. A fluid-tight connection structure between a substantially cylindrical vertical side wall and a hanging roof of a storage tank, particularly for molten salt, said side wall being of the corrugated type with substantially parallel vertical corrugations, wherein said connection structure comprises a plurality of longitudinally arcuate metal strip-like connecting elements, each being provided with at least one longitudinally extending corrugation, a crest of which is formed with spaced transverse depressions and at each side of said corrugation with a longitudinally extending originally substantially transversely flat side portion from which said corrugation extend perpendicularly towards the interior of the tank, the corrugations of said connecting elements having a cross-section corresponding to one of the vertical side wall corrugations, said corrugation cross-section having a form of an acute angle, allowing deformation of said corrugation substantially along the line of said crest for presenting a progressively decreasing width from one end to the other, without deformation of the cross-section of said corrugation at the widest end, said side portions of each connecting element being deformable for transforming said initially flat transverse shape into an arcuate shape corresponding to the arcuate shape of the cylindrical side wall of the tank, each connecting element being tightly secured, after having been subjected to said deformations, by each of its longitudinally extending side portions to a longitudinally extending side portion of an adjacent element to form an annular portion of a sphere, said sphere portion being fluid-tightly secured at its radially outer circular edge portion in overlapping relationship to the vertical tank side wall so that said corrugations and said corrugation side portions of said annular sphere portion at said outer edge portion match the vertical corrugations and the corrugation side portions of the tank side wall, and at its radially inner edge portion to the roof of the tank.

2. A structure according to claim 1, wherein said transverse depressions are substantially dihedral in shape.

3. A structure according to claim 1, wherein said metal sheet strip-like connecting elements are made from an alloy with a high nickel content.

4. A structure according to claim 3, wherein said alloy is INCOLOY 800.

5. A structure according to claim 1, wherein said radially inner edge portion of said annular sphere portion bears against a horizontal flange of a reinforcing beam of the hanging roof.

6. A structure according to claim 5, wherein said radially inner edge portion of said annular sphere portion is welded underneath and against the horizontal flange of the reinforcing beam of the hanging roof.

7. A storage tank, in particular for a molten salt, comprising a substantially cylindrical vertical side wall and a hanging roof, said side wall being of a corrugated type with at least substantially vertical parallel corrugations, and a connecting structure forming a fluid-tight connection between said vertical side wall and said roof of the tank, said connecting structure having the shape of an annular portion of a sphere, said connecting structure being formed of a plurality of arcuate metal sheet strip-like connecting elements each being provided with at least one longitudinally extending corrugation, the crest of which is formed with spaced transvere depressions, and at each side of said corrugation with a longitudinally extending originally substantially flat side portion from which said corrugations extend perpendicularly towards the interior of the tank, said corrugations of said connecting elements having a cross-section corresponding to one of said vertical side wall corrugations, said cross-section having a form of an acute angle allowing deformation substantially along said crest line for obtaining progressively decreasing widths from one end to the other without deformation of said cross-section of said corrugation at the widest end, said side portions of each element being deformable for transforming said initially flat shape into an arcuate transverse shape corresponding to the arcuate shape of said cylindrical side wall of the tank, each connecting element being tightly secured, after having been subjected to said deformations, by each of its longitudinally extending side portions to a side portion of an adjacent element to form said annular portion of said sphere, said sphere portion being fluid-tightly secured with its outer circular edge portion in overlapping relationship to said vertical side wall so that said corrugations and said corrugation side portions of said annular sphere portion at said outer edge portion match said corrugations and said corrugation side portions of said vertical wall, with its radially inner edge portion to said roof of the tank.

8. A tank according to claim 7, wherein said substantially cylindrical vertical side wall comprises substantially parallel horizontal corrugations orthogonally intersecting said substantially vertical corrugations.

9. A tank according to claim 7, wherein said hanging roof is substantially flat and circular in shape.

10. A tank according to claim 7, wherein said annular sphere portion is fluid-tightly welded to said substantially vertical side wall.

11. A structure according to claim 1, wherein the substantially cylindrical vertical side wall comprises substantially parallel horizontal corrugations orthogonally intersecting the substantially vertical corrugations.

12. A structure according to claim 1, wheein the hanging roof is substantially flat and circular in shape.

* * * * *